US005263229A

United States Patent [19]

Drummond

[11] Patent Number: 5,263,229

[45] Date of Patent: Nov. 23, 1993

[54] BOW PIN AND SYSTEM FOR FORMING DECORATIVE BOWS

[76] Inventor: Daniel D. Drummond, 333 E. 49th St. PHM, New York, N.Y. 10017

[21] Appl. No.: 650,682

[22] Filed: Feb. 5, 1991

[51] Int. Cl.[5] ..... A44B 9/04

[52] U.S. Cl. ..... 24/13; 24/711.2

[58] Field of Search ..... 24/6, 13, 711.2, 108, 24/711.4, 94, 49 CP, 711, 13; 411/923, 485, 498, 494, 484, 439

[56] References Cited

U.S. PATENT DOCUMENTS

| | | | |
|---|---|---|---|
| 212,297 | 2/1879 | Allen | 24/711.4 X |
| 488,219 | 12/1892 | Platt | 24/108 |
| 2,076,655 | 4/1937 | Light | 24/711.2 |
| 2,538,396 | 1/1951 | Sutin | 24/108 |
| 2,806,313 | 9/1957 | James | 428/5 |
| 2,862,321 | 12/1958 | James | 428/5 |
| 2,933,223 | 4/1960 | Kravig et al. | 223/46 |
| 3,112,240 | 11/1963 | Kravig et al. | 428/5 |
| 3,430,302 | 3/1969 | Reagan, Jr. et al. | 24/108 |
| 3,689,962 | 9/1972 | Erickson | 24/108 |
| 4,700,435 | 10/1987 | Bugh | 24/94 |
| 5,031,285 | 7/1991 | Wallo | 24/490 PX |

FOREIGN PATENT DOCUMENTS

| | | | |
|---|---|---|---|
| 389573 | 9/1908 | France | 24/711.2 |
| 870182 | 3/1942 | France | 411/494 |
| 1679 | 7/1908 | United Kingdom | 24/711.2 |

*Primary Examiner*—James R. Brittain
*Attorney, Agent, or Firm*—Morgan & Finnegan

[57] ABSTRACT

A bow pin and bow-pin system are provided. The bow pin is formed with a preferably cylindrical shaft having a tip at one end which includes a tapered portion, preferably conical in shape, terminating in a sharp point for use in hand-forming applications. The angle of taper defining the sharp point is no greater than about 9.5 degrees, making it possible to manually press the pin through multiple layers of ribbon and underlying packaging material with a force no greater than 7.5 lbs, preferably no greater than 4 lbs. The base of the tip is of greater diameter than the shaft creating an annular retaining shoulder when the tip is forced through ribbon material and a package or other similar structure. The pin also includes a head of suitable size and shape to facilitate manual insertion and to provide an aesthetically pleasing appearance. A method is further provided whereby this specially designed pin is used to manually attach multiple layers of ribbon material to a package or similar structure to form a bow in situ.

16 Claims, 3 Drawing Sheets

BOW PIN AND SYSTEM FOR FORMING DECORATIVE BOWS

BACKGROUND OF THE INVENTION

The present invention relates to an improved device and system for hand-forming decorative bows on packages. In particular, the invention involves the production in situ of decorative bows made from lengths of ribbon material and to the provision of novel bow pins for forming the bows and fastening them to gift boxes or other structures made from similar materials by hand.

Decorative bows can be purchased pre-made or consumers can create the bow themselves. However, making bows by hand is extremely difficult for the average consumer. Great dexterity is required to both manipulate the ribbon material into the form of a bow and then to somehow secure the bow so that it does not unravel. As a result, the tendency is to buy pre-made bows even though they are expensive and are generally sold without matching ribbon. Additionally, many consumers would prefer to create their own bows if doing so were not prohibitively difficult. A self-made bow leaves room for creativity and thus is more fulfilling than using pre-made bows.

Prior art decorative bows are generally machine-manufactured. For example, U.S. Pat. Nos. 2,933,223 and 3,112,240 to Kravig disclose mass production machinery for prefabricating bows using special pins. The Kravig pins are similar in general appearance to the pin of the present invention. However, there is a basic difference. The Kravig pin is designed for machine application, whereas the pin of the instant invention is designed for hand application. This is significant because of the difficulty of pressing a pin through ribbon material, especially multiple layers of ribbon material in the form of a bow.

The Kravig patent specifications are silent as to the dimensions of the pin, but as illustrated in the drawings the pin appears to be unsuitable for hand application because of the large angle of taper of the point. Hence, a high degree of force would be required to press the pin through the ribbon material. The amount of force required for insertion of the Kravig pin is not a problem, as it is intended for machine application where resistance to penetration is not a limiting factor.

A principal object of the present invention is to provide an improved bow pin and bow-pin system for the creation of decorative bows by hand without the use of complicated machinery.

A further object of the present invention is to provide an improved bow pin which will enable the user to create bows from ribbon and attach the bows to a package or other structure with minimal insertion force.

Another object of the present invention is to provide an improved bow pin and bow-pin system that will enable the user to create elegant bows at a fraction of the cost of conventional prefabricated bows.

Still another object of the present invention is to provide an improved bow pin and bow-pin system that will enable the user to create elegant bows from the same strip ribbon material used to tie packages.

SUMMARY OF THE INVENTION

The foregoing and other objects of the present invention are provided by a bow pin comprising a shaft, a tip at one end of the shaft including a tapered portion terminating in a sharp point and a head at the other end of the shaft. In accordance with the invention, the angle of taper defining the point is no greater than about 9.5 degrees so that the tip can simply and easily pierce the stacked ribbon and underlying packaging material through manual pressure. The base of the tip has a dimension greater than that of the shaft to form a retaining shoulder outside the shaft which prevents the bow pin from pulling out after insertion. The head of the pin is of a suitable size and shape to provide a comfortable surface for the application of thumb pressure and to provide an aesthetically pleasing appearance.

In addition to provision of a novel bow pin, the present invention also provides a novel method for the creation of the decorative bow itself. In accordance with the method of the present invention, ribbon material is folded by hand to create a suitable number of overlaying loops. Using no more than about 7.5 lbs insertion force, and preferably no more than about 4 lbs insertion force, the tip of the bow pin is then pressed through the stacked loops at the point of intersection and then pressed through the package material to which the bow is to be secured. The loops are then fanned out to form an aesthetically pleasing decorative bow with multiple loops, or they can be left unfanned.

The present invention provides a bow pin and bow-pin system that will allow the user to create beautiful and distinctive decorative bows quickly and easily. With only bow pins of the invention, a user can create complex and beautiful bows using the same ribbon material from which the package itself is tied. In addition to economy in material usage, the invention assures that bow and packing ribbon are perfectly matched.

With the bow pin and bow-pin system of the present invention, the user can be creative without having special skills. Further, users can create original bows almost as fast as they can apply a pre-made bow of the type that requires removal of adhesive backing material.

DETAILED DESCRIPTION OF ILLUSTRATIVE EMBODIMENTS

Figure 1:
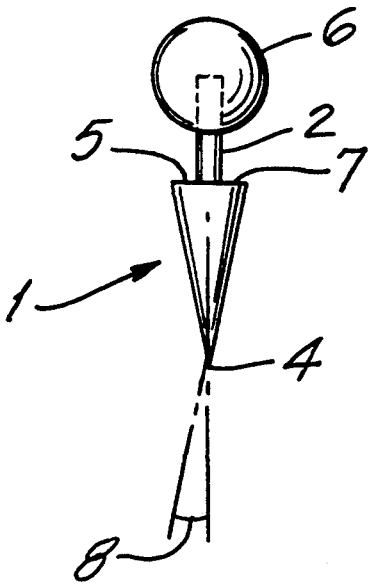
FIG. 1 is a side elevation view of the preferred embodiment of the bow pin of the present invention.
Figure 2:
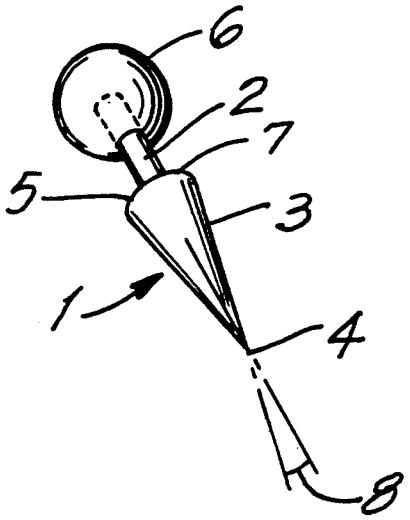
FIG. 2 is a skewed end view of the preferred embodiment of the bow pin of the present invention.

A preferred embodiment of the bow pin of the invention is shown in FIGS. 1 and 2. The pin 1 comprises a shaft 2, preferably a right circular cylinder, having at one end a tip portion 3, preferably conical in shape, tapering to a sharp point 4 from a base 5, and having at the other end a head 6 which is preferably spherical. The diameter of the base 5 is greater than the shaft diameter so as to form an annular shoulder 7 whose function will be more fully explained below.

In accordance with the invention, the angle of taper 8 of the conical tip 3 defining the sharp point 4 is critical. The taper angle must not be too large, or the pin would be unsuitable for its intended use as a hand applied article due to the resistance to penetration of the layered ribbon material. It has been determined that the maximum useful taper angle for normal practice of the invention is about 9.5 degrees.

An angle of about 9.5 degrees or less enables the user to comfortably insert a bow pin having a tip base diameter of 0.030 inch and a 0.125 inch diameter spherical head (the reasons for using these dimensions are detailed below) through 13 layers of satin (woven) or sheen (laminated) ribbon with normal corrugated packaging as a backing. This maximum angle was determined through testing, which indicated (1) that an average of about 7.5 lbs is the maximum insertion force that a person can apply by hand to a pin having a 0.125 inch diameter spherical head without exceeding their pain threshold, (2) that about 4 lbs is the upper limit of force that a typical user can repeatedly apply to a pin having a 0.125 inch diameter spherical head without significant discomfort, and (3) that a pin having a tip base diameter of 0.030 inch and a taper angle of about 9.5 degrees would require no more than about 4 lbs of force to pierce 13 layers of ribbon (which is the minimum number of layers required to form a full bow) and a corrugated cardboard container. As is more fully explained below, the minimum taper angle is limited only by the dimension of the base in relation to that of the shaft needed to form an adequate retaining shoulder and the practical limits on the length of the tip.

Figure 4:
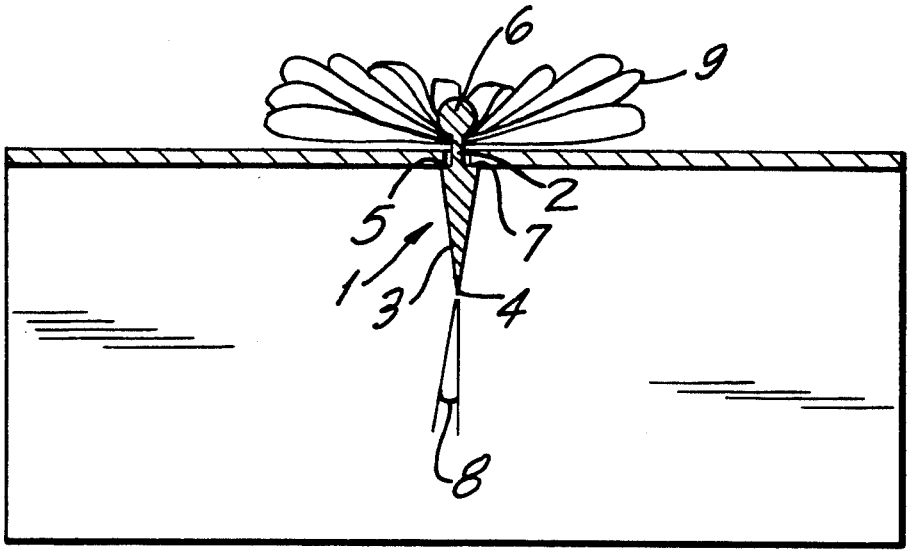
FIG. 4 is a vertical cross-sectional view taken along line A—A of FIG. 3.
Figure 5A:
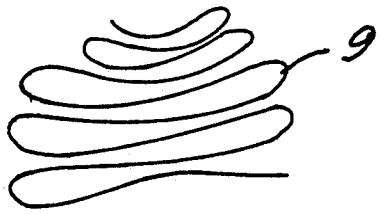
FIGS. 5*a*, 5*b* and 5*c* are diagrammatical illustrations of the method of hand fabricating bows in accordance with the instant invention.
Figure 5B:
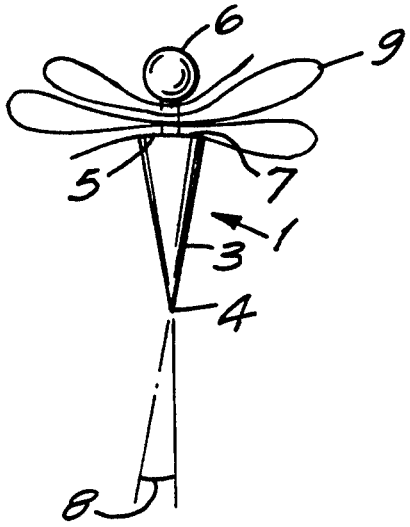

As shown in FIGS. 4 and 5*b*, the portion of the base 5 surrounding the shaft 2 forms an annular shoulder 7 to keep the pin from pulling out after its tip has been inserted through the ribbon and package material. More specifically, as shown in FIG. 4, the annular shoulder 7 presses against the inner surface of the packaging material thereby acting as a stop. It is important that the base 5 be of a sufficiently larger diameter than the shaft 2 to form an annular shoulder 7 large enough to hold the pin in place. A base diameter about 1.5 times the diameter of shaft 2 is suitable for practice of the invention. It is also important that the base 5 be less than about 0.040 inch in diameter because, if the base were any larger it would tend to tear the laminated fibers in sheen ribbon during insertion and would drive insertion force well above the 7.5 lbs that a person can apply by hand to a pin having a 0.125 inch diameter spherical head.

In a preferred embodiment, the conical tip 3 is about 0.090 inch in length, the angle of taper 8 is about 9.5 degrees, and the base 5 is about 0.030 inch in diameter. The shaft 2 is about 0.020 inch in diameter.

The shaft of a typical pin is about 0.030 inches in diameter. Testing has determined that with a taper angle of about 9.5 degrees, the lower practical limit on the shaft diameter of bow pins of the instant invention is about 0.020 inch. Below that diameter, a pin fabricated from standard pin material will tend to break or bend under the force needed for insertion of a bow pin having an angle of about 9.5 degrees.

With a shaft 2 diameter of about 0.020 inch, the diameter of base 5 can be as small as about 0.030 inch and still provide a shoulder 7 of adequate size to function as a retaining means. Thus, about 0.030 inch is the minimum base diameter that can be used with pins made of standard material. For pins having a conical tip of about 0.090 inch in length, which is typical for a bow pin useful in the practice of the invention, a 0.030 inch base results in a taper angle of about 9.5 degrees.

The length of the shaft 2 between the tip 3 and head 6 must be sufficient to accommodate the combined thickness of the layered ribbon material 9 and package structure 10. On the other hand, the shaft must not be too long or it will not hold the bow firmly in place. In the preferred embodiment, the shaft is about 0.220 inch in length between the tip and head.

The pin head 6 may be of any suitable shape and size which would comfortably allow the user to press the pin through the ribbon and package material with a finger, preferably the thumb. For example, the head may be spherical as illustrated in the preferred embodiment. A spherical shape also enhances the decorative appearance of the pin, especially when the head is of the same color as the bow. In the preferred embodiment, the pin head is about 0.125 inch in diameter and is composed of a decorative plastic material. It is felt that a larger pin head would detract from the appearance of the bow.

In its preferred form, the conical tip 3 and the shaft 2 comprise a single, integrally manufactured unit. The pin head may be attached to the shaft by any suitable means, such as by force fit frictional engagement. This is accomplished by forming a hole in the plastic pin head of a slightly smaller diameter than the shaft and then pressing the head onto the shaft. The pin head could also be manufactured integrally with the conical tip and shaft. In this case, the decorative appearance of the pin head would be achieved by dipping the head in paint.

The fabricating technique envisioned for production of the pin of the present invention could be the same as that used for production of garment or other such similar pins. The pins could be extruded, cold rolled or made by any other suitable process. The basic fabricating process is not critical.

It can be appreciated that the tip may have any suitable geometry providing the necessary sharp point and shoulder-forming base. For example, the tip may have, in addition to a tapered portion defining the point, a cylindrical section extending from the tapered portion in the direction of the head. Such an alternative embodiment is illustrated in FIG. 6.

Figure 6:
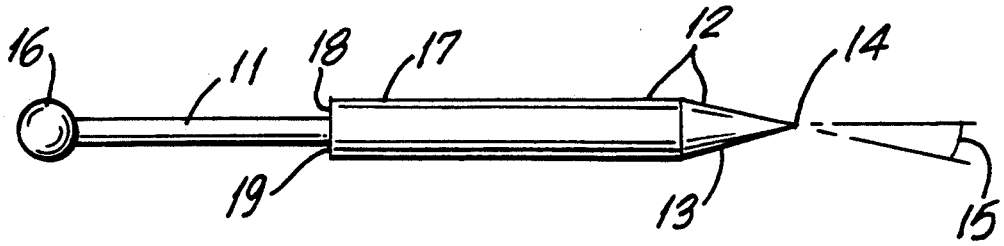
FIG. 6 illustrates an alternative bow pin configuration embodying the invention.

FIG. 6 illustrates a pin formed with a shaft 11, a tip 12 having a tapered conical portion 13 terminating in a sharp point 14 defined by taper angle 15, and a head 16 at the end of the shaft opposite the tip. The tip further includes a cylindrical section 17 which extends the tip towards the head of the pin. The free end or base 18 of the cylindrical extension forms an annular shoulder 19 where it joins with the reduced-diameter shaft 11. In such embodiment, the cylindrical extension 17 may be 0.160 inch in length, all other dimensions being the same as in the first illustrative embodiment.

Figure 3:
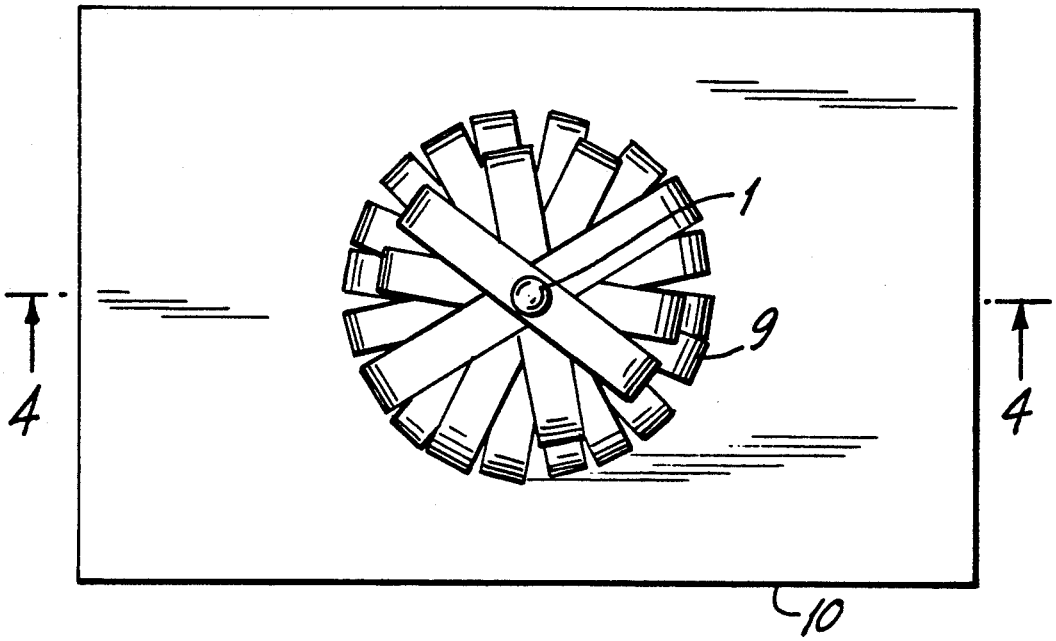
FIG. 3 is a top plan view of a decorative bow formed by the method and system of the present invention and fastened by a bow pin to a package in accordance with the present invention.
Figure 5C:
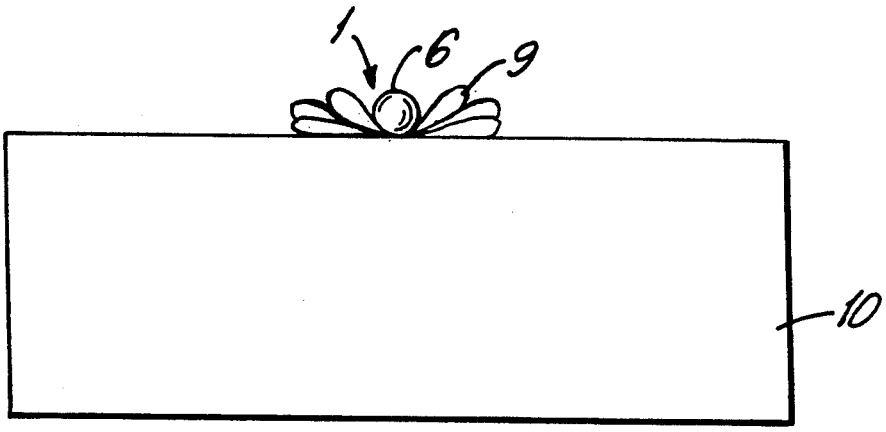

Referring to FIGS. 3 and 4, it can be seen that a continuous length of ribbon material 9 is stacked by folding segments of ribbon over themselves. FIG. 4 shows a cross-sectional view of the ribbon and pin assembly inserted into a package. FIG. 3 shows the ribbon fanned out by rotating it about the pin after the pin has been inserted into the package. The method of creating the bows is simple in that the user stacks the ribbon on itself as shown in FIG. 5*a*, then uses the thumb to press the tip of the pin through the material as shown in FIG. 5*b* or 5*c* while holding the shaft between the pointer and middle fingers, and then fans the ribbon loops out to produce the bow shown in FIG. 3. As can be seen from FIGS. 5*b* and 5*c*, the pin can be inserted through the stacked ribbon material and then, at a later time, into the package. More preferably, both operations can be effected continuously.

Because of their resiliency, after the tip has passed through the ribbon and packaging material, the material will spring back against the shaft with the annular shoulder functioning as a stop to lock the pin in place. In the illustrative embodiments, the bow pin would accommodate combined package and ribbon thicknesses up to about 0.220 inch. However, the pin dimensions could be altered to accommodate various thicknesses of ribbon and packaging material.

While preferred embodiments of the present invention have been illustrated and described, those skilled in the art will appreciate that numerous changes and modifications can be made within the spirit of the invention. As an example, the pin shaft need not be cylindrical in shape and the tapered portion of the tip need not be conical. The pin could possibly be made by a stamping process, which would produce a tip in the nature of an arrowhead and a shaft having a rectangular cross-section. The appended claims are intended to cover all those changes and modifications falling within the true spirit and scope of the present invention.

What is claimed is:

1. A bow pin for use in combination with ribbon material which enables the manual formation in situ of decorative bows retained by and secured to gift packages and the like comprising:

(a) a shaft, a head connected to one end of said shaft and a tip connected to the other end of said shaft, (b) said tip including a tapered portion terminating in a point and having a base opposite said point, said base being larger in lateral dimension than the portion of said shaft to which it is connected thereby forming a retaining shoulder extending outwardly beyond said shaft and said base being less than about 0.040 inch in outer lateral dimension, (c) said tip having an angle of taper no greater than about 9.5 degrees to define a sharp point and a narrow base operative to puncture and pass through by manually applied force multiple layers of ribbon material and underlying packaging material, (d) said retaining shoulder being operative once said tip has been inserted through said layers of ribbon to hold said ribbon on said pin in the form of a bow, and to hold said bow in place after said tip has been inserted into said packaging material.

2. A device in accordance with claim 1 wherein said shaft is cylindrical in shape, said tapered portion of said tip is conical in shape and said retaining shoulder is an annular surface surrounding said shaft.

3. A device in accordance with claim 2 wherein said base of said tip is about 1.5 times larger in diameter than said shaft.

4. A device in accordance with claim 2 wherein said angle of taper is about 9.5 degrees.

5. A device in accordance with claim 2 wherein said base of said tip is about 0.030 inch in diameter and said conical portion of said tip is about 0.090 inch in length.

6. A device in accordance with claim 2 wherein said tip further includes a cylindrical portion extending from said tapered conical portion towards said head, said base being the free end of said cylindrical portion.

7. A bow pin device for use in combination with ribbon material which enables the manual formation in situ of decorative bows retained by and secured to gift packages and the like comprising:

(a) a pin having a shaft, a head at one end of said shaft configured to serve as a bearing surface for the application of finger pressure, and a tip at the other end of said shaft generally in the shape of an arrowhead, (b) said tip including a tapered portion terminating in a sharp point defined by a taper angle no greater than about 9.5 degrees and having a narrow base opposite said point which is larger in lateral dimension than the portion of the shaft to which it is connected to form a retaining shoulder outside said shaft, the lateral dimension of said base being less than about 0.040 inch to enable said tip to puncture and pass through multiple layers of ribbon material without substantially tearing the same, said retaining shoulder thereafter being operative in conjunction with said ribbon material to keep said tip from pulling out so that said layered ribbon material is held in the form of a bow on said shaft and said fabricated bow is held in place after said tip has been inserted into packaging material.

8. A bow pin device in accordance with claim 7 wherein the angle of taper defining said point is no greater than about 9.5 degrees.

9. A bow pin device in accordance with claim 7 or 8 wherein said base of said tip is about 1.5 times larger in outer lateral dimension than said shaft.

10. A bow pin device in accordance with claim 8 wherein said shaft is cylindrical, said tapered portion of said tip is conical in shape and said retaining shoulder is an annular surface surrounding said shaft.

11. A bow pin device in accordance with claim 10 wherein said shaft has a diameter in the range of about 0.020 inch to about 0.030 inch, said base of said tip has a diameter in the range of about 0.030 inch to about 0.040 inch and said annular shoulder has a radial dimension of about 0.005 inch to 0.01 inch.

12. A bow pin device in accordance with claim 10 or 11 wherein said tip further includes a cylindrical portion extending from said tapered conical portion towards said head, said base being the free end of said cylindrical portion.

13. A bow pin device in accordance with claim 1, 7, 8, 10 or 11 wherein said pin is a cold rolled material.

14. A bow pin device for use in combination with ribbon material which enables the manual formation in situ of decorative bows retained by and secured to gift packages and the like comprising:

(a) a pin having a cylindrical shaft, a head at one end of said shaft configured to serve as a bearing surface for the application of finger pressure, and a conical tip at the other end of said shaft generally in the shape of an arrowhead having a sharp point and a base opposite said point which is larger in diameter than said shaft to define an annular retaining shoulder surrounding said shaft, (b) said tip having an angle of taper of about 9.5 degrees and a base of about 0.030 inch in diameter, said shaft being about 0.020 inch in diameter adjacent said tip and about 0.220 inch in length between said head and said tip, whereby the tip of said pin has a sharp enough point and a small enough outer diameter to readily puncture and pass through multiple layers of ribbon material without substantially tearing the same yet has a retaining shoulder of sufficient size to prevent said tip from pulling back out through the opening formed by said tip so that said layered ribbon material is held in the form of a bow on said shaft and said fabricated bow is held in place after said tip has been inserted into packaging material.

15. A bow pin device in accordance with claim 14 wherein said head is generally spherical in shape and is about 0.125 inch in diameter.

16. A bow pin device in accordance with claim 14 or 15 wherein said pin is a cold rolled material.

* * * * *